US009327334B2

(12) United States Patent
Buta et al.

(10) Patent No.: US 9,327,334 B2
(45) Date of Patent: May 3, 2016

(54) STRETCHING DEVICE

(71) Applicants: John R. Buta, Salem, OH (US); Ryan Craig Mercer, Columbiana, OH (US)

(72) Inventors: John R. Buta, Salem, OH (US); Ryan Craig Mercer, Columbiana, OH (US)

(73) Assignee: Butech Bliss, Salem, OH (US)

( * ) Notice: Subject to any disclaimer, the term of this patent is extended or adjusted under 35 U.S.C. 154(b) by 175 days.

(21) Appl. No.: 14/100,430

(22) Filed: Dec. 9, 2013

(65) Prior Publication Data

US 2014/0096582 A1 Apr. 10, 2014

Related U.S. Application Data

(63) Continuation-in-part of application No. 12/483,742, filed on Jun. 12, 2009, now Pat. No. 8,833,126.

(60) Provisional application No. 61/060,999, filed on Jun. 12, 2008.

(51) Int. Cl.
*B21D 25/04* (2006.01)
*B21D 11/02* (2006.01)

(52) U.S. Cl.
CPC ..... *B21D 25/04* (2013.01); *B21D 11/02* (2013.01)

(58) Field of Classification Search
CPC ..... B21D 25/00; B21D 25/04; B21D 11/02; B25B 1/241; B25B 1/2457; B25B 1/2463; B25J 15/04; B25J 15/0433
See application file for complete search history.

(56) References Cited

U.S. PATENT DOCUMENTS

| | | | | |
|---|---|---|---|---|
| 3,247,565 | A | 4/1966 | Griffin | |
| 4,751,838 | A | 6/1988 | Voges | |
| 4,982,593 | A | 1/1991 | Holloway | |
| 5,077,887 | A | 1/1992 | Holloway | |
| 5,181,411 | A | 1/1993 | Holloway | |
| 5,491,999 | A | 2/1996 | Holloway | |
| 6,205,830 | B1 | 3/2001 | Voges | |
| 6,227,027 | B1 | 5/2001 | Holloway | |
| 6,460,391 | B1 * | 10/2002 | Liefer et al. | 72/302 |
| 6,612,145 | B2 | 9/2003 | Rohleder | |
| 6,732,561 | B2 | 5/2004 | Voges | |

* cited by examiner

*Primary Examiner* — Debra Sullivan
(74) *Attorney, Agent, or Firm* — Fay Sharpe LLP

(57) ABSTRACT

A stretching device has a housing, a first clamping member attached to a first portion of the housing, a second clamping member attached to a second portion of the housing, a first insert mounted to the first clamping member, and a second insert mounted to the second clamping member. The first insert and the second insert protect workpieces to be clamped and gripped therebetween. The inserts are releasably mounted to gripping surfaces of the clamping members.

22 Claims, 15 Drawing Sheets

STRETCHING DEVICE

CLAIM OF PRIORITY

This application is a continuation-in-part of application Ser. No. 12/483,742, filed on Jun. 12, 2009, which in turn claims priority from Provisional Application No. 61/060,999, filed on Jun. 12, 2008. Each application is hereby incorporated herein by reference.

BACKGROUND OF THE DISCLOSURE

The present disclosure relates to rolled or extruded metal and sheet metal or metal plate processing. More particularly, the present invention relates to a method and apparatus for stretching extruded or sheet metal using a stretcher machine.

A wide variety of manufactured goods contain processed sheet metal. For example, aircraft, automobiles, file cabinets and household appliances, to name only a few, contain sheet metal. The sheet metal is typically purchased directly from steel mills and/or steel service centers, but may be passed through intermediate processors (sometimes referred to as "toll" processors) before it is received by an original equipment manufacturer.

Various methods exist for flattening or stretching sheet metal. Flatness of sheet metal is important because virtually all stamping and blanking operations require a substantially flat sheet. Also, in certain applications, such as in the aerospace industry, residual stress free material is critical. Good surface conditions are also important, especially in applications where the top and/or bottom surfaces of the metal sheet will be painted.

There are a number of common defects that effect sheet metal flatness. For example, when sheet metal is rolled into coil form for convenient storage and transportation, the strip tends to take on a coiled shape. This curvature is commonly referred to as "coil set." Coil set occurs because the sheet metal has been bent past its yield point. More specifically, when sheet metal is coiled, the metal fibers near the inside surface of the curved sheet are compressed past their yield point, and the metal fibers near the outside surface of the curved sheet are stretched past their yield point. Another type of shape defect known as "edge wave" occurs if the edge portions of the sheet are no longer than the center portion of the sheet, resulting in undulations in one or both of the edge portions of the sheet. A similar type of shape defect known as "center buckle" results if the center portion of the sheet is longer than one or both of the edge portions, which results in bulging or undulating of the central portion of the sheet.

An existing method of flattening sheet metal is called "stretcher leveling." A conventional C-frame stretcher leveler is shown schematically in FIG. 1. Stretcher leveling is generally considered to be a superior flattening process because, unlike roller leveling and temper processing, it rectifies the problem of internal residual stresses in the sheet metal and produces a flatter product without crown reduction. As shown in FIG. 1, a typical C-frame stretcher leveler includes a pair of generally C-shaped grippers or jaws G that securely grips the opposing ends of the sheet S to be stretched. The surface portions of the grippers that engage or grip the sheet metal to hold the sheet against movement during stretching are typically grooved, knurled or serrated to provide a secure grip. In operation, the grippers G are hydraulically or pneumatically controlled to engage the opposed ends of the sheet S and, once a firm contact is made, hydraulic actuators (not shown) move the grippers in opposite directions from one another to stretch the metal sheet S held therebetween in opposed directions.

The entire cross section of the metal sheet is stretched past its yield point (i.e., beyond its elastic limit) such that all internal residual stresses are eliminated from top to bottom and from side to side.

However, a problem with a conventional C-frame stretcher leveler is that it cannot be used with continuous strips of metal because the C-shaped grippers clamp at the opposed ends of a metal sheet, as shown in FIG. 1. Another problem with conventional C-frame stretcher levelers is that the grippers bite deeply into the metal and disfigure the top and bottom surfaces of the sheet. Traditionally, the disfigured portions of the sheet are cut off as scrap, which results in a substantial amount of wasted material. Also, operation of a C-frame stretcher leveler is very labor intensive because the individual sheets must be moved into and out of the machine between operations. Aside from cutting off the disfigured portions, conventional C-frame stretcher levelers do nothing to improve the surface quality of the sheet metal.

U.S. Pat. No. 4,751,838, issued to Kenneth Voges, discloses an "in-line stretcher leveler." The teachings of this patent are incorporated herein by reference. The basic components of conventional in-line stretcher leveler are shown schematically in FIG. 2. As shown in FIG. 2, a typical in-line stretcher leveler includes a first set of upper and lower gripping members GU1 and GL, and a second set of upper and lower gripping members GU2 and GL2. The gripping members are hydraulically or pneumatically controlled to engage top and bottom surfaces of the metal sheet S and, once a firm contact is made, hydraulic actuators (not shown) move the first and second sets of gripping member in opposite directions from one another to stretch the segment of the metal sheet S positioned between the two pairs of gripping members. Then, the gripping members are released and the metal sheet S is advanced so that the next section of the metal sheet can be stretched. Because the gripping members of the in-line stretcher leveler engage the metal sheet from the top and bottom, rather than at opposing ends, the in-line stretcher leveler can be used to stretch any length of sheet metal by successive stretching operation. As disclosed in U.S. Pat. No. 4,751,838, unlike the grippers of the C-frame stretcher leveler, the gripping members GU1 and GL1, GU2 and GL2 of the in-line stretcher leveler preferably have engagement surfaces that are sufficiently smooth to avoid marring or otherwise disfiguring the surfaces of the metal sheet S. This is particularly advantageous because there are no disfigured portions to be cut off as scrap, which results in substantial cost savings. Also, this process is far less labor intensive than C-frame stretcher leveling.

A problem with some existing stretchers is that the cam-style jaw has a profile such that the gripping angle changes depending on the thickness of the workpiece. This results in less efficient and unreliable gripping force across a variety of extrusion thicknesses or sizes. Also, the gripping force is disproportional to the stretching force. It is thus desirable to provide a stretcher for extrusions or plates or sheets which provide a uniform or constant gripping angle using an eccentric cam profile jaw for various extrusion sizes or thickness and a gripping force which is proportional to the stretching force.

Another problem with existing stretchers is that the gripping jaws may cause damage to the sheet being stretched. That is, the teeth of the jaws may make an unsightly and undesirable deformation or imprint in the sheet of metal, thus, possibly rendering it unusable or at least aesthetically unpleasing. Thus, there is a need for a stretching device which provides an insert mounted to the stretchers which protects and prevents damage to the material being stretched.

SUMMARY OF THE DISCLOSURE

The disclosure relates to a stretching device. More particularly, it relates to an extrusion stretching device which provides a uniform or constant gripping angle and a gripping force to which is proportional to the stretching force on the extruded piece of sheet metal or a plate of metal.

The stretching device has opposite ends, a "head" stretcher and a "tail" stretcher which are used to pull an extrusion through the stretcher, wherein the "tail" has a cam-style jaw which holds the extrusion in place and is stationary, while the "head" has a cam-style jaw which grips and clamps down or the extrusion and moves to stretch the extrusion or pulls it through the device.

Each cam-style jaw has a geometry such that the gripping angle of the jaw is the same, regardless of the thickness of the cross section of the extrusion. In previous stretchers, the angle of the cam would change depending on the thickness of the workpiece, thus affecting the efficiency or effectiveness of the device.

Furthermore, the gripping force of the cam jaw which now results is proportional to the stretching force exerted on the workpiece. The gripping angle between the jaw and the workpiece or extension remains constant regardless of the thickness of the workpiece.

Thus, the harder the stretcher pulls on the workpiece, i.e., the larger the stretching force, the larger the gripping force. Thus, the gripping or wedging force is directly proportional to the stretching force.

In accordance with one aspect of the present disclosure, a stretching device has a housing; a first clamping member attached to a first portion of the housing; a second clamping member attached to a second portion of the housing; wherein the first clamping member comprises a movable pivot member such that an angle of contact between the first clamping member and a workpiece to be gripped remains constant regardless of the workpiece's thickness.

In accordance with another aspect of the present disclosure, a stretcher assembly, has a first stretcher having a first housing including a first clamping member and a second clamping member opposed to each other; and a second stretcher including a second housing having a third clamping member and a fourth clamping member opposed to each other; a workpiece support member interposed between the first stretcher and the second stretcher, wherein the first and third clamping members each has a movable pivot joint such that an angle of contact of the first and third clamping members with a workpiece to be gripped remains constant regardless of a thickness of the workpiece.

In accordance with another aspect of the disclosure, a method of stretching a workpiece includes: providing a first stretcher assembly; providing a second stretcher assembly; providing a support member between the first stretcher assembly and the second stretcher assembly; moving the first stretcher assembly into a desired location and securing the first stretcher assembly in the location; providing a pair of clamping members to the first and second stretcher assemblies; feeding a workpiece between the first and second stretch assemblies; clamping the workpiece between each pair of clamping members by moving each clamping member until the clamping members exert a gripping force on the workpiece; wherein the clamping members are configured such that an angle of gripping contact between the clamping members and the workpiece remain constant regardless of the thickness of the workpiece; and moving the second stretcher assembly away from said first stretcher assembly to exert a stretching force on the workpiece.

Yet another aspect of the disclosure is an extrusion stretcher which has optimized cam style jaws which provide a uniform, reliable gripping force across the full range of extrusion sizes. The stretcher effectively grips the piece and virtually eliminates any slippage.

Still another aspect of the disclosure is the extrusion stretcher has two ends; i.e., the head end or stretcher and the tail end or stretcher. The larger end, the tail, has a cam-style jaw which wedges on clamps down on the work piece and remains stationary. The smaller end, the head end, also has a cam-style jaw which wedges and clamps the workpiece but also pulls on the workpiece and stretches it.

Another aspect of the disclosure is the jaw has a geometric cam profile such that a gripping angle between the jaw and the workpiece is constant for various workpiece thicknesses.

According to another aspect of the disclosure, a stretching device has: a housing; a first clamping member attached to a first portion of the housing; a second clamping member attached to a second portion of the housing; a first insert mounted to the first clamping member, and a second insert mounted to the second clamping member, wherein the first insert and the second insert protect workpieces to be clamped therebetween.

In accordance with another aspect of the disclosure, a stretcher assembly has a first stretcher comprising a first housing having a first clamping member and a second clamping member opposed to each other; and a second stretcher comprising a second housing having a third clamping member and a fourth clamping member opposed to each other; a workpiece support member interposed between the first stretcher and the second stretcher; wherein the first and third clamping members each comprise a movable pivot joint such that an angle of contact of the first and third clamping members with a workpiece to be gripped remains constant regardless of a thickness of the workpiece; and each of the first, second, third, and fourth clamping members comprises an insert mounted thereon to protect the workpiece to be gripped.

In accordance with another aspect of the disclosure, a method of stretching a workpiece includes: providing a first stretcher assembly; providing a second stretcher assembly; providing a support member extending between the first stretcher assembly and the second stretcher assembly; moving the first stretcher assembly into a desired location and securing the first stretcher assembly in the location; providing a pair of clamping members to each of the first and second stretcher assemblies; providing an insert releasably mounted to each of the clamping members to protect a workpiece to be stretched; feeding the workpiece between the first and second stretcher assemblies; clamping the workpiece between each pair of clamping members by moving the clamping members until the clamping members exert a gripping force on the workpiece; wherein the clamping members are configured such that an angle of gripping contact between the clamping members and the workpiece remains constant regardless of the thickness of the workpiece; and moving the second stretcher away from the first stretcher to exert a stretching force on the workpiece.

Still another aspect of the disclosure is that the pivot point of the jaw moves up or down so that the angle of contact between the jaw and the workpiece remains constant regardless of the thickness of the workpiece.

Still another aspect of the disclosure is that the gripping or clamping force is proportional to the stretching force.

Another aspect of the disclosure is that the cam jaws exert a uniform, reliable gripping force on workpieces across a full range of workpiece thicknesses.

Still another aspect of the disclosure is that the jaw pre-grips the workpiece and virtually eliminates slippage.

Another aspect of the disclosure is inserts mounted to the stretchers which protect and prevent damage to the workpiece being stretched. Still another aspect of the disclosure is an insert which provides a gripping surface that can protect oiled strip metal as well as dry strip metal.

Other aspects of the disclosure will become apparent upon a reading of the following description.

DETAILED DESCRIPTION OF THE DISCLOSURE

Figure 1:
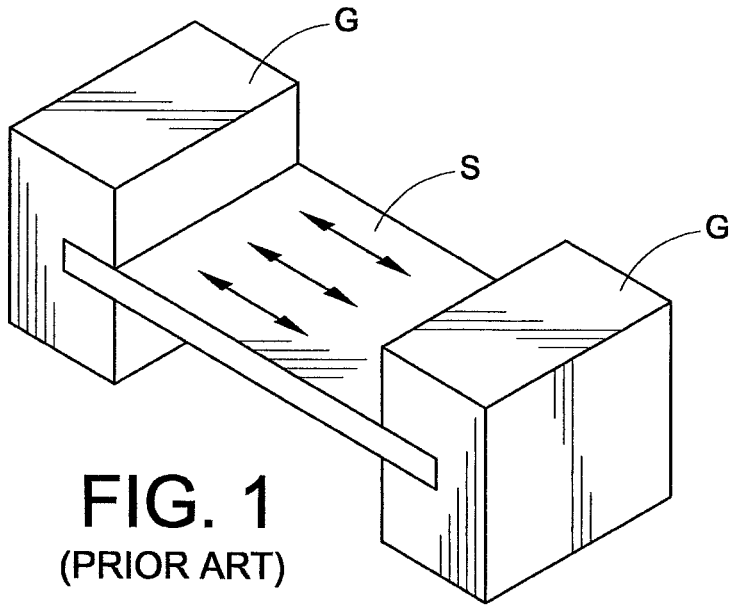
FIG. 1 (PRIOR ART)
FIG. 1 is a schematic representation of an existing C-frame stretcher leveler.
Figure 2:
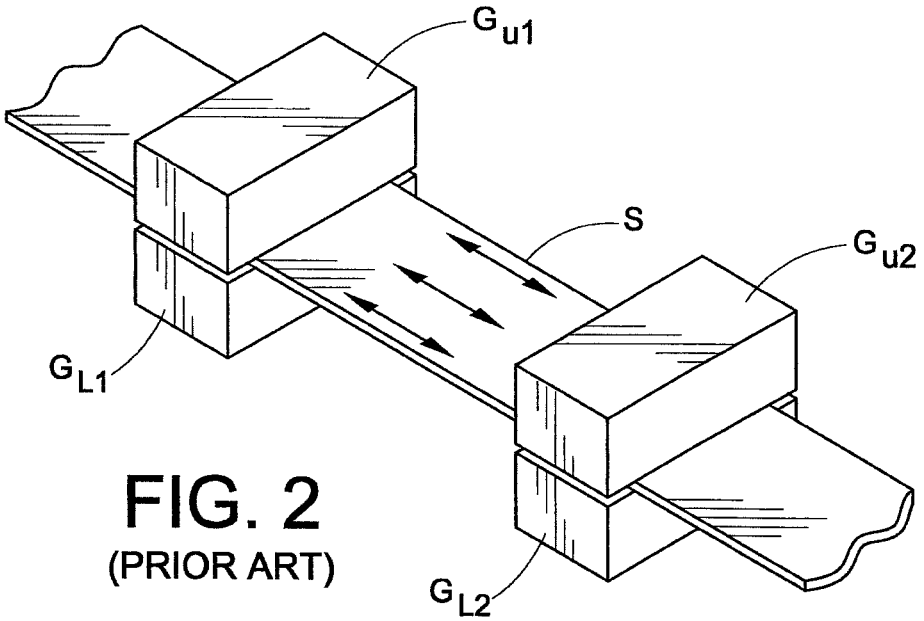
FIG. 2 (PRIOR ART)
FIG. 2 is a schematic representation of an existing in-line stretcher leveler.
Figure 3:
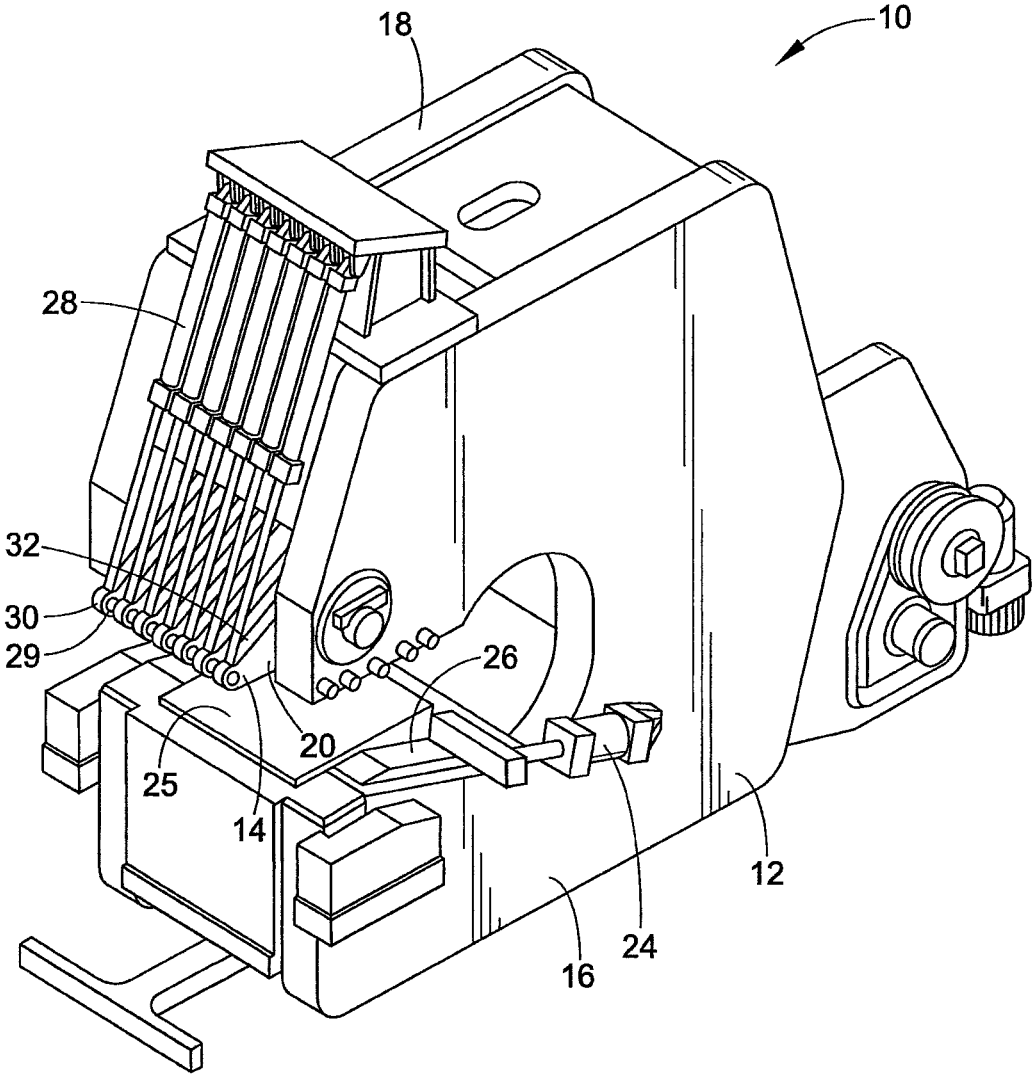
FIG. 3 is a perspective view of the tail stretcher assembly in accordance with the present disclosure.
Figure 4:
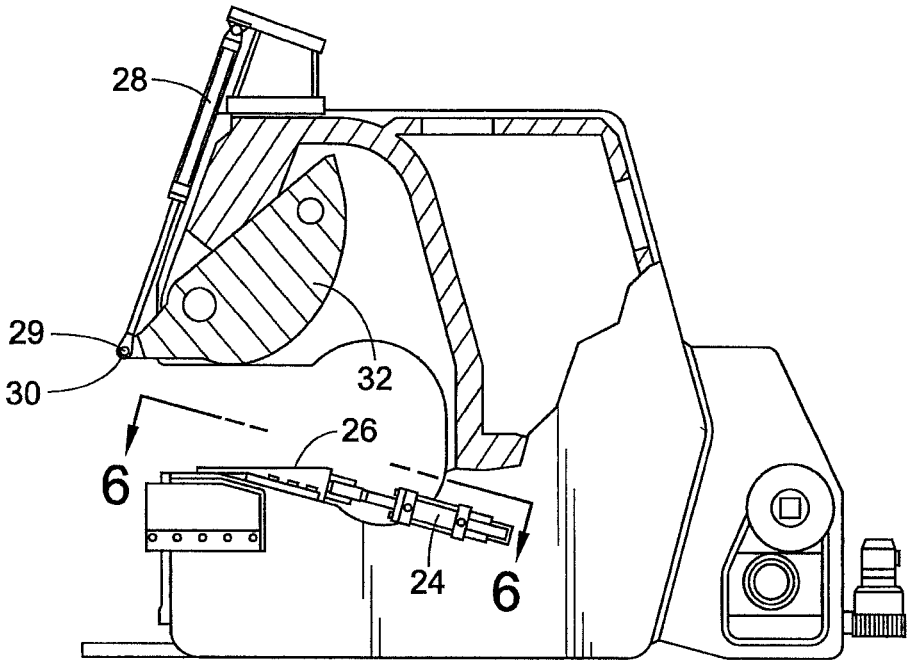
FIG. 4 is a side elevational view of a tail stretcher with a clamping jaw in an retracted or up configuration in accordance with the present disclosure.
Figure 5:
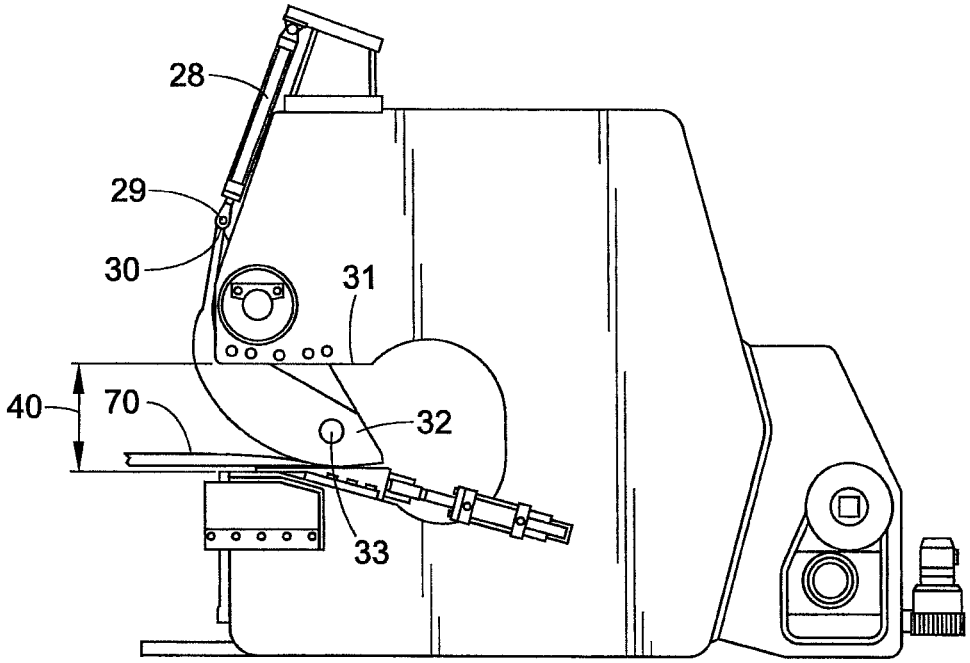
FIG. 5 is a side elevational view of a tail stretcher with a clamping jaw in an extended or down configuration in accordance with the present disclosure.

A method of flattening sheet metal using a stretcher is called "stretcher leveling." A stretcher, in accordance with the present disclosure is shown in FIGS. 3-14. Stretcher leveling is generally considered to be a superior flattening process because, unlike roller leveling and temper processing, it rectifies the problem of internal residual stresses and produces a flatter product without crown reduction. As shown in FIGS. 3-5, a 350-ton stretching force capacity stretcher includes a "tail stretcher" assembly 10 which has a pivoting cam-style jaw assembly which is shown in an "up" and "down" position in FIGS. 4 and 5. The cam jaw assembly pivots up or retracts into a housing 12.

FIG. 3 shows a tail stretcher assembly 10 in accordance with a preferred embodiment of the present disclosure. Housing 12 of the tail stretcher assembly supports an upper clamping member or jaw assembly 14 which is mounted securely thereon between opposed parallel side plates 16, 18 of the housing and together extend the full width of an opening or gap 20 (about 21 inches) formed between the two opposed side plates of the housing. The jaws are each about three inches wide (see FIG. 13). The tail assembly is adjusted into position based on differing lengths of the workpiece and then is locked into place and remains stationary.

The eccentric cam-style gripper or jaw assembly 14 securely grips one of the opposing ends of an extrusion or a sheet of metal to be stretched. The surface edges or portions 22 of the jaws that engage or grip the sheet metal to hold the sheet against movement during stretching are typically grooved, knurled or serrated (see FIG. 7) to provide a secure grip. In operation, the jaws are hydraulically or pneumatically controlled to engage one of opposed ends of the sheet and exert a gripping force on the sheet, and, once a firm contact is made, a series of hydraulic actuators 28 actuate the jaws in an up and down position to firmly grip the metal sheet held therebetween, thereby exerting a gripping or wedging force on the sheet.

A coil strip of metal, such as steel or titanium, is positioned to run between the jaws. Where the distance between jaws of opposing stretcher assemblies is great, for example, 50 feet or more, the strip is supported by a plurality of rolls or other support means. A length of the workpiece to be stretched can range from several feet to over 100 feet in length.

The gripping surface of a jaw can be made of a material strong enough not to break down or tear away from the support surface under an applied force up to 350 tons. The gripping jaw surface must also have a coefficient of friction great enough to prevent slippage of the surface with respect to the workpiece being stretched during operation of the stretcher. Additionally, the gripping jaw should not damage the workpiece that it grips or stretches.

It has been found that it is desirable that the width of the jaw gripping surface be from about three inches in width. However, other widths are contemplated by the disclosure.

To prepare the stretchers for operation, a metal strip is withdrawn from a coil. Then with the clamping assemblies of the stretching machine in their raised positions, the strip is fed between the jaws through the space between the guide plates on the lower frame, and finally between the jaws of the upper jaw assembly. In other words, the strip is advanced along a path through the stretcher.

Specifically, referring again to FIGS. 3-5, the tail assembly 10 has a pair of hydraulic cylinders 24 attached to opposite sides of a bottom jaw assembly 26 formed by a substantially flat plate 25 (which can have knurls or serrations) on opposite sides of housing 12. A plurality of hydraulic cylinders 28 are attached to openings 29 in ends 30 (FIG. 12) of a plurality of upper eccentric cam-style jaws 32 of jaw assembly 14 which are arranged adjacent and parallel to each other. In the preferred embodiment, seven jaws 32 and cylinders 28 are shown parallel and adjacent to each other, but other numbers of jaws can be modified without departing from the of the disclosure. Both the bottom jaw assembly 26 and upper jaws 32 are mounted to housing 12 between side plates 16, 18.

Figure 6:
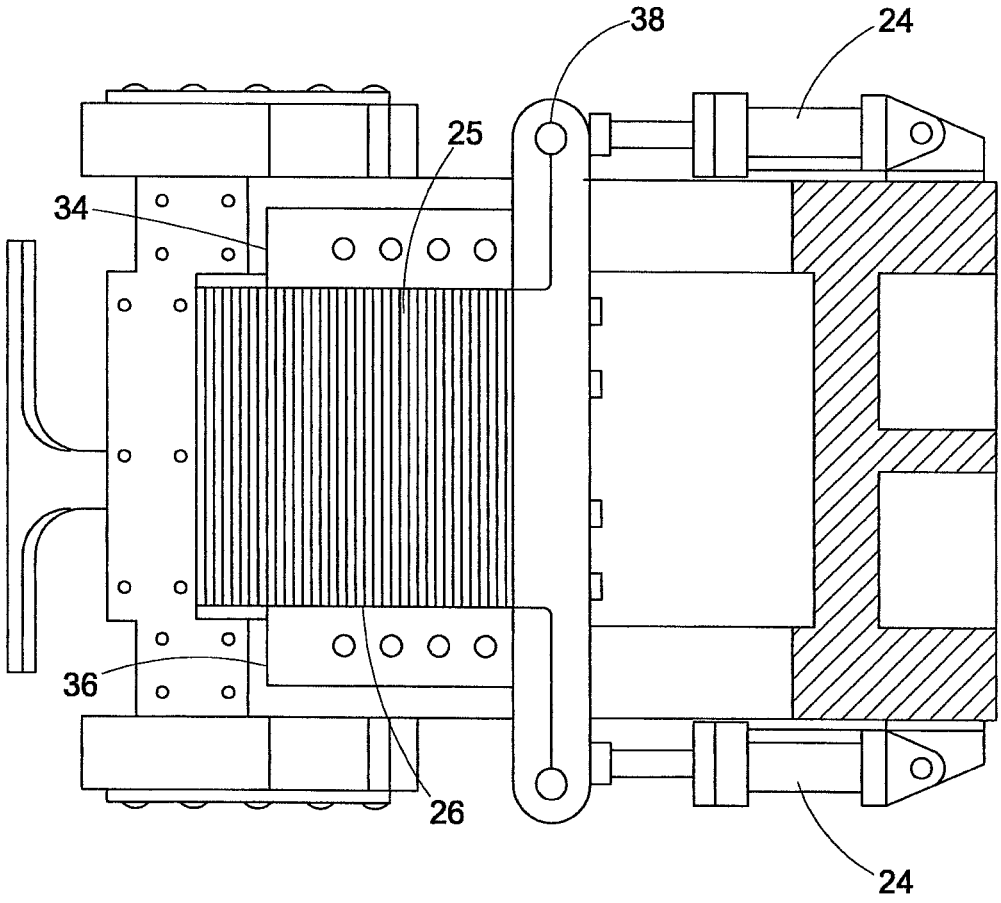
FIG. 6 is a view of the lower jaw assembly taken along lines 4-4 of FIG. 4.

Referring now to FIG. 6, the bottom jaw plate 25 is interposed between two jaw guide plates 34, 36 which in turn are used to extend the bottom jaw outwardly. Cylinders 24 are attached to opposite ends of a cylinder control bar 38. Control bar 38 is used to release the grip on the workpiece.

Figure 7:
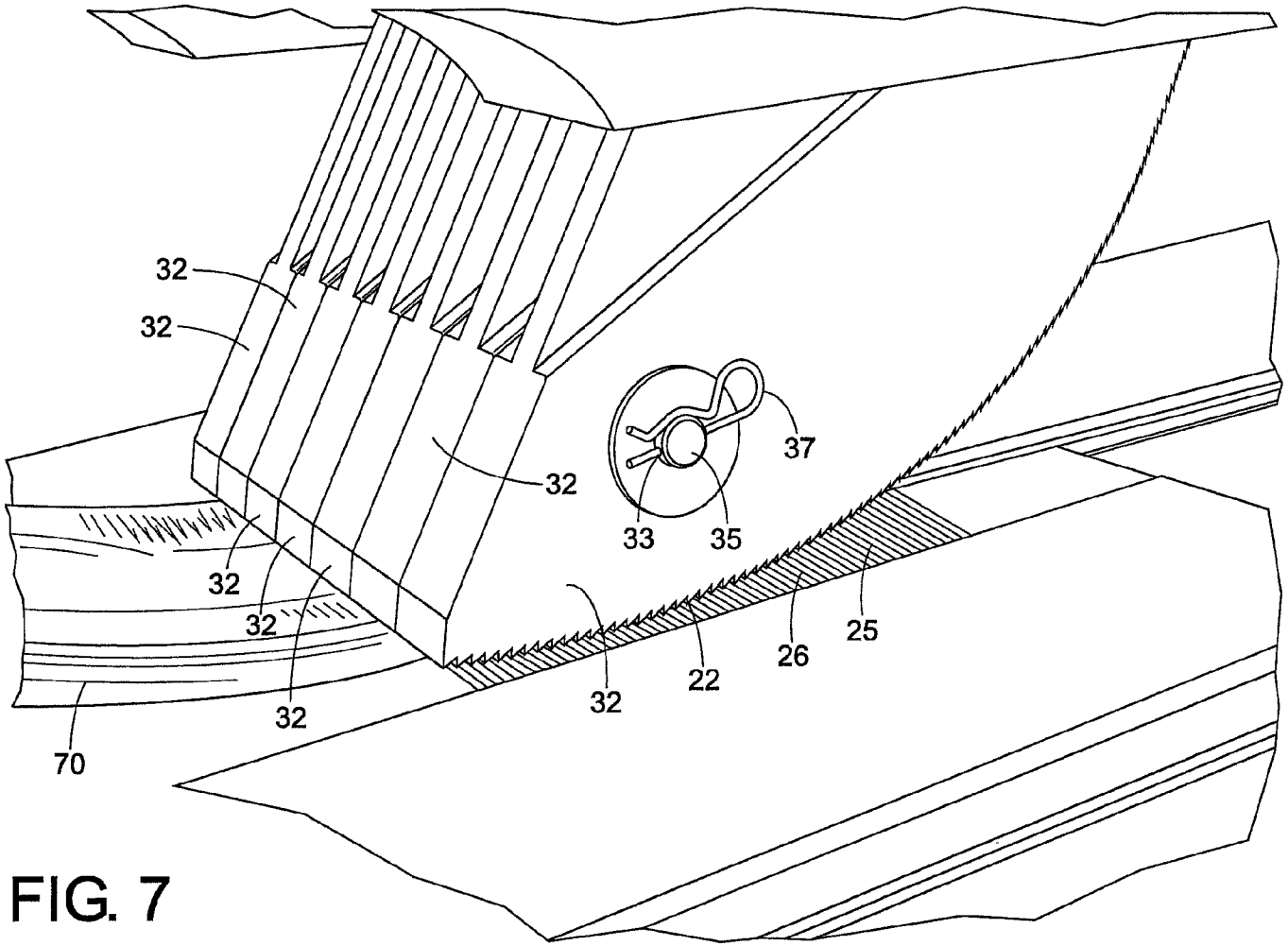
FIG. 7 is a perspective view of the clamping jaws with a retaining pin therethrough.

As seen in FIG. 7, the clamping jaws 32 each have an opening 33 through which an aligning rod 35 is inserted to maintain alignment of the jaws as they rotate between up and down positions. A locking pin 37 is inserted through the rod to lock it in place. One or more of the jaws 32 may be lowered to clamp a workpiece 70. That is, a single jaw or up to all seven jaws can be lowered onto a workpiece to grip the workpiece.

An upper portion of housing 12 encloses the upper jaw assembly in the retracted or "up" position. An opening or gap 40 (FIG. 5) of about 16 inches is formed in the housing between the portion 31 of the housing enclosing the upper or top jaw assembly 14 and the bottom or lower jaw assembly 26.

A workpiece 70 is inserted into the tail assembly between the upper and lower jaw assemblies when the upper jaw assembly is in the retracted position (FIG. 5). Then, the cylinders are used to lower or extend the upper jaws into contact with the workpiece (FIG. 4) wedging and gripping the workpiece. The lower jaw is extended by the hydraulic cylinders (FIG. 4).

Figure 8:
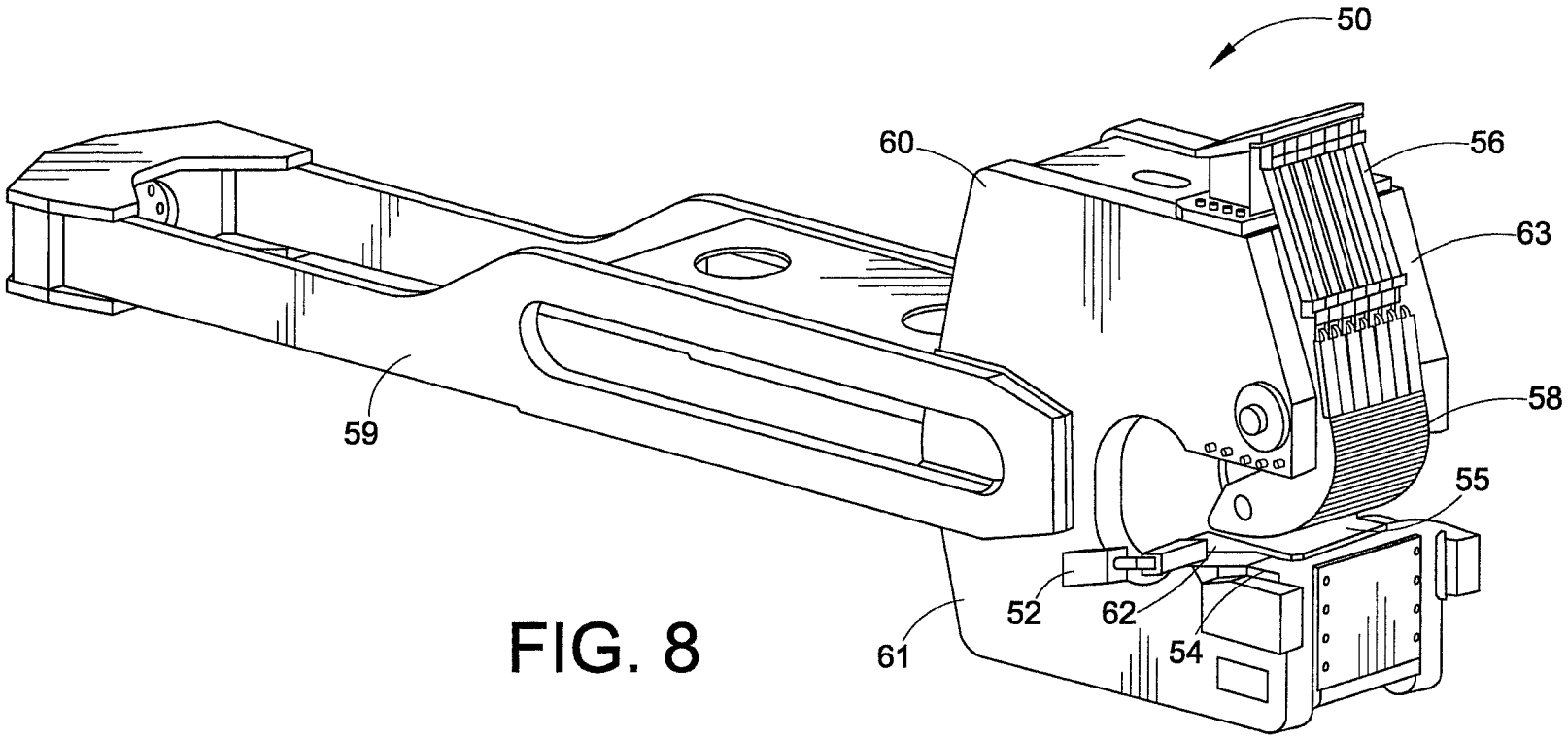
FIG. 8 is a perspective view of a head stretcher assembly in accordance with the present disclosure.
Figure 9:
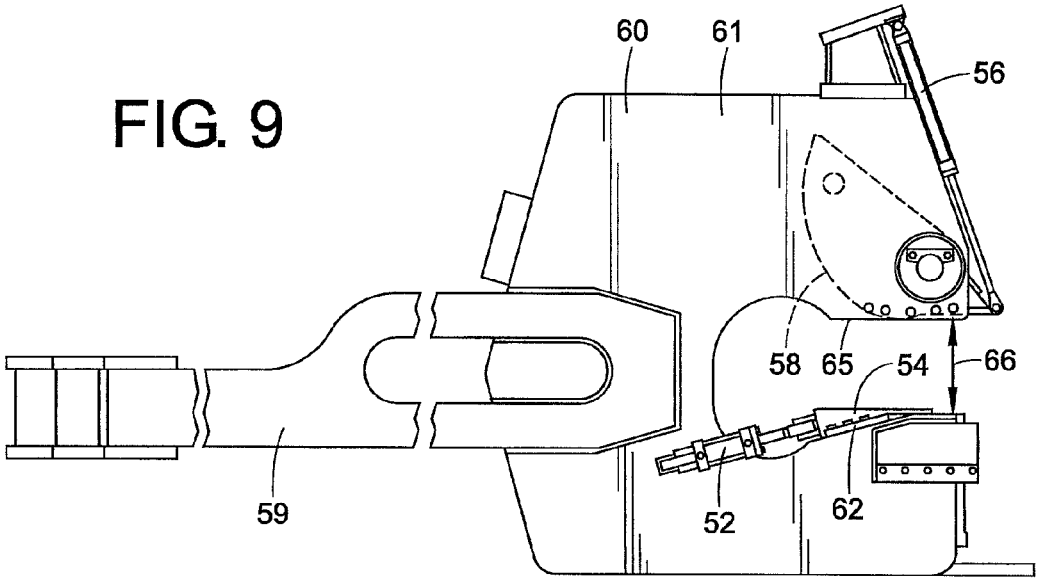
FIG. 9 is a side elevational view of the head stretcher with a clamping jaw in a retracted or up position in accordance with the present disclosure.
Figure 10:
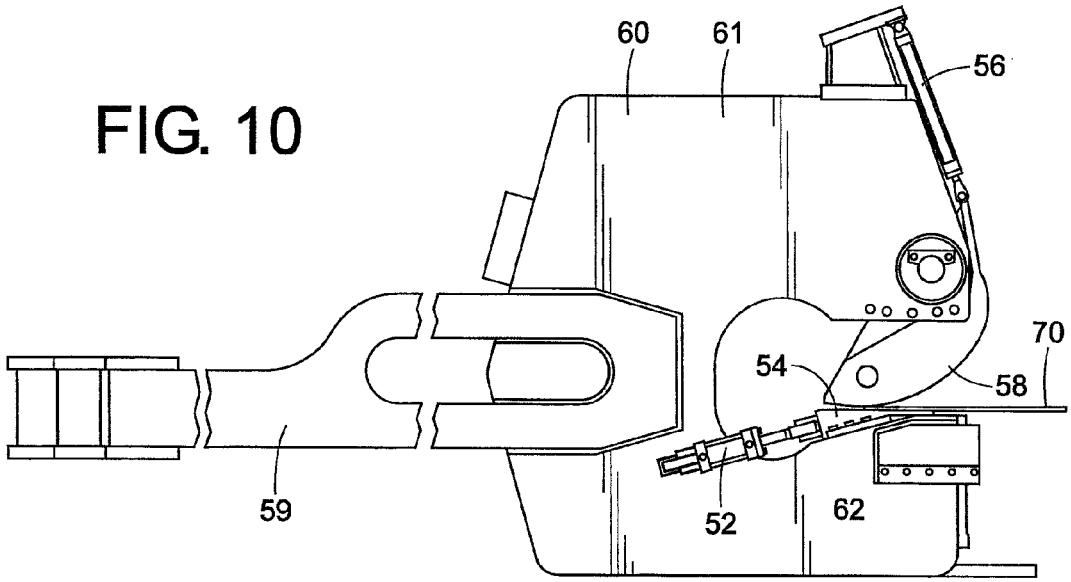
FIG. 10 is a side elevational view of the head stretcher with the clamping jaw in the down position.

Referring now to FIGS. 8, 9 and 10, a movable head stretcher assembly 50 in accordance with the preferred embodiment of the disclosure is shown. The components of the head stretcher are substantially the same as the tail stretcher shown in FIGS. 3-7.

The head stretcher assembly has a pair of hydraulic cylinders 52 attached to a bottom jaw assembly 54 including a substantially flat plate 55. A plurality of hydraulic cylinders 56 are attached to a plurality of upper eccentric cam-style jaws 58 which are arranged adjacent and parallel to each other. In the preferred embodiment, seven jaws 58 and cylinders 56 are shown, but other numbers of jaws can be used without departing from the of the disclosure. Both the bottom jaw assembly 54 and upper jaws 58 are mounted to a housing 60 between opposed side walls 61 and 63.

The bottom jaw is interposed between two jaw keepers or guide members 62, which in turn are used to extend the bottom jaw outwardly.

The head stretcher assembly 50 also has an eccentric cam-style jaw assembly which pivots between "up" and "down" positions into and out of housing. The head assembly cam jaw extends downwardly exerts a gripping force and wedges against the workpiece or extrusion and clamps it into place. The jaws in the head assembly remain stationary and do not exert any stretching force on the workpiece. The jaws of the tail assembly housing move away from the head housing 60 in direction D (FIG. 11) to exert a stretching force on the workpiece.

Housing 60 encloses the upper jaw assembly in the retracted or "up" position between opposing side walls 61, 63. An opening 66 (FIG. 9) of about 16 inches is formed in the housing between the housing portion 65 enclosing upper or top jaw assembly and the bottom or lower jaw assembly 54.

Workpiece 70 is inserted into the head assembly between the upper and lower jaw assemblies when the upper jaw assembly is in the retracted position (FIG. 9). Then, the cylinders are used to lower or extend the upper jaws into contact with the workpiece wedging and gripping the workpiece (FIG. 10). The lower jaw can be extended by the hydraulic cylinders (FIG. 10).

The entire cross section of the metal sheet is typically stretched past its yield point (i.e., beyond its elastic limit) such that all internal residual stresses are eliminated from top to bottom and from side to side.

In typical operation, a strip is positioned between jaws which are hydraulically or pneumatically controlled. Once a firm contact is made with the strip, hydraulic cylinders actuate a pair of jaws to move in opposite direction from the other pair to elongate the strip between the jaw pairs. Once elongation has been achieved, jaw pairs are opened and the stretched portion of strip can be incrementally taken up on takeup coil and the next stretching operation can begin.

Figure 11:
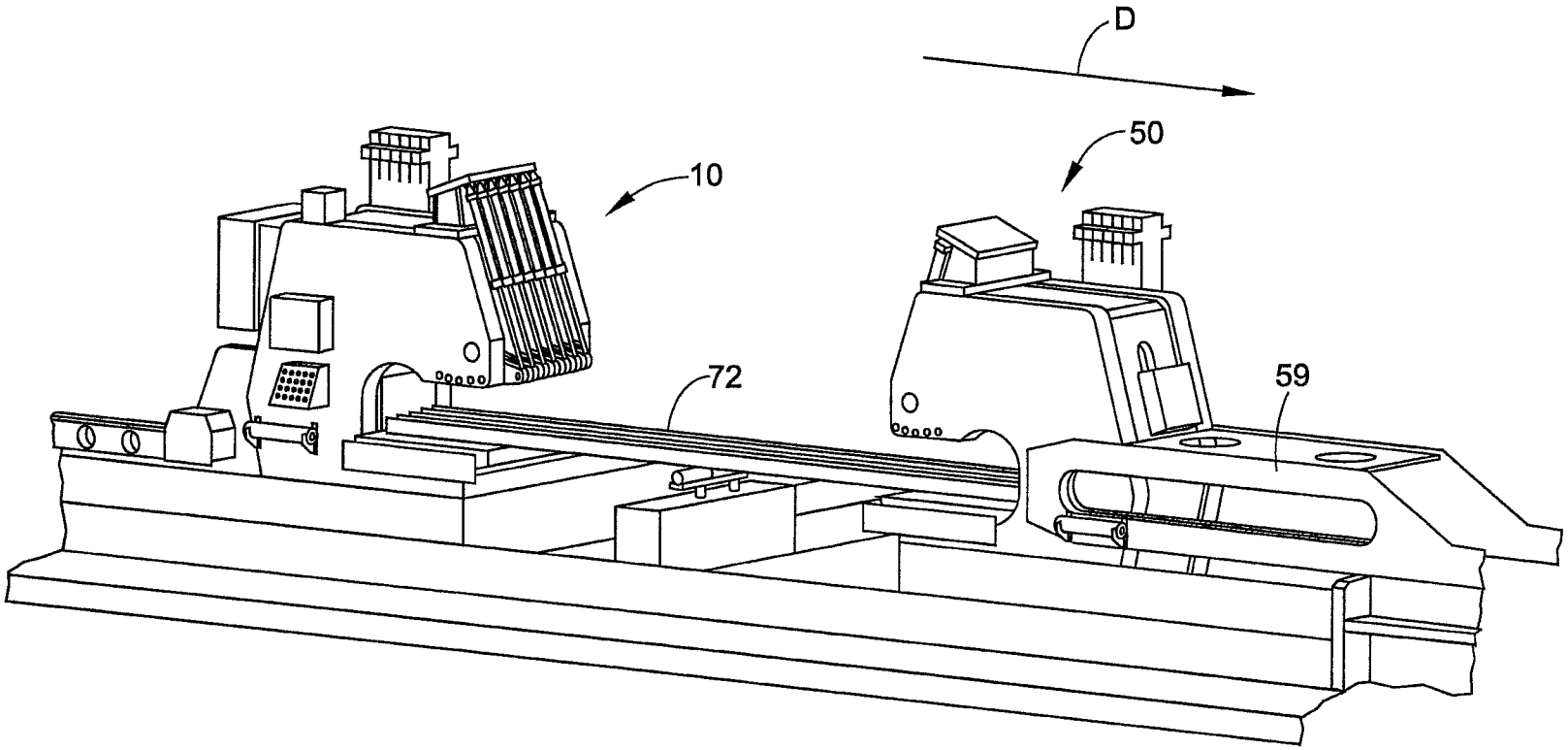
FIG. 11 is a perspective view of the head stretcher and tail stretcher assembly.

Referring now to FIG. 11, the head stretcher assembly 50 and tail stretcher assembly 10 are shown positioned opposite each other with a workpiece conveyor line or support member such as a plurality of rollers 72 interposed between them for supporting a workpiece. The tail and head stretcher can be spaced from several feet to over 100 feet from each other, depending on the length of the workpiece.

The cylinders move the clamping jaws for the respective housings downwardly, causing the opposed jaws to approach each other and clamp down and wedge against the strip. The number of clamping cylinders energized depends on the width of the workpiece or strip 70, since it is not desirable to apply the clamping force much beyond the edges of the strip. At each housing, the clamping force produced by the cylinders that are energized is distributed uniformly across the strip or workpiece. The clamping cylinders effect a tight grip across the strip at each set of clamping jaws, yet the jaws do not damage the surfaces of the strips.

The stretcher can include a feeding mechanism (not shown), including a plurality of powered rollers for pulling the sheet metal strip 70 through the stretcher assembly. The feeding mechanism can advance the sheet metal strip 70 through the stretcher assembly at precise increments.

With the clamping jaws in the up position, the sheet metal strip 70 is fed between the upper and lower gripping jaws. The clamping cylinders are energized on each of the housings to move the clamping mechanisms (jaws 32, 58) downwardly to bring the jaws 32, 58 into firm engagement with the top surface of the sheet metal strip 70. The upper gripping jaws or members approach the lower gripping members (lower jaws 26, 54) so that the sheet metal strip 70 is gripped firmly therebetween. With the strip tightly gripped between the upper and lower gripping members, a hydraulic stretching cylinder (not shown) is energized to exert a pulling force on a bracket 59 attached to the head to move the movable housing 60 of the head stretcher 50 away from the fixed housing 12 of the tail stretcher 10 in direction D (FIG. 11) to stretch that portion of the sheet metal strip 70 between the gripping members of the movable housing past its yield point to remove substantially all internal residual stresses in that portion of the strip 70. Then, the clamping cylinders 56 remain energized while the stretching cylinder is released. This allows the portion of the strip that was stretched to recover at least some of its elastic deformation, which may bring the movable housing back toward the fixed housing a short distance. Thereafter, cylinders 56 are energized to lift the clamping mechanisms upwardly a distance sufficient to clear the way for the strip 70 to be advanced by the feeding mechanism for the next stretching operation.

Figure 12:
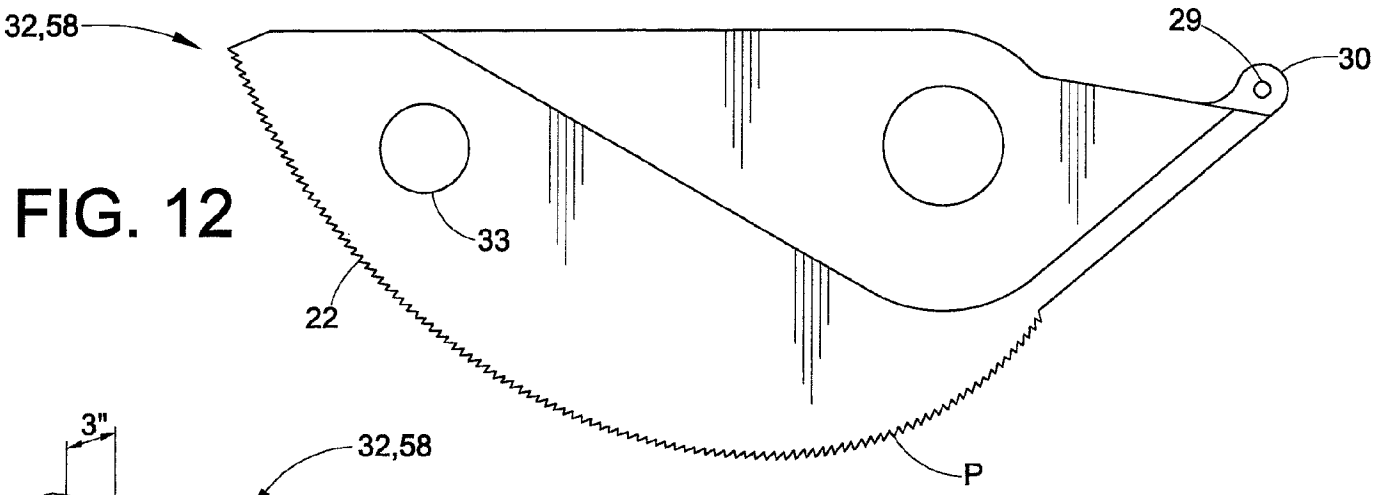
FIG. 12 is a side elevational view of a cam-style jaw of the stretcher in accordance with the present disclosure.
Figure 13:
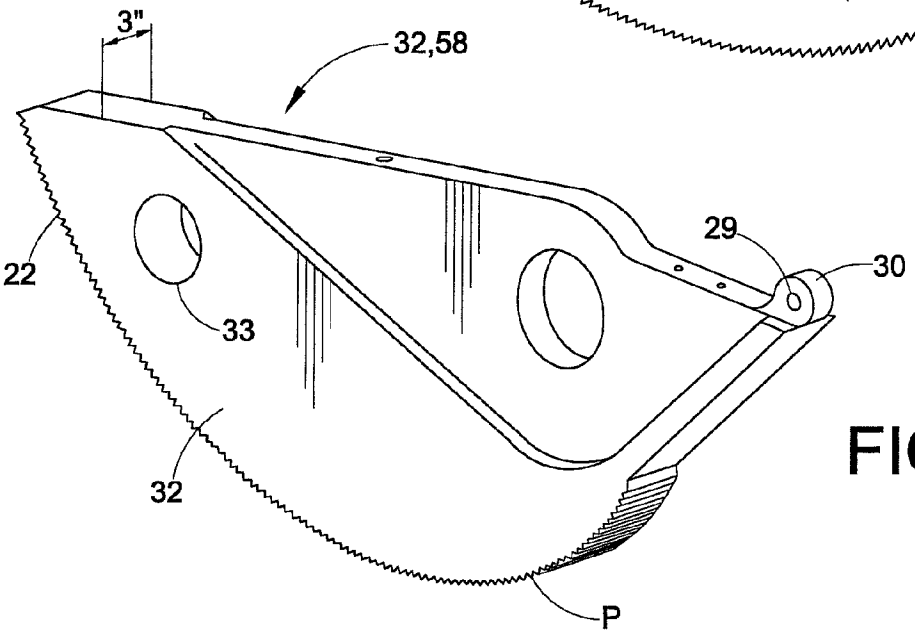
FIG. 13 is a perspective view of the cam-style jaw of FIG. 12.

The upper cam jaw 32, 58 used in both the tail stretcher and head stretcher is shown in FIGS. 12 and 13. The cam profile P of the jaw 32, 58 is configured such that the structural geometry or profile of the jaw forms a gripping angle (the angle of contact) between the edge 22 of the jaw and the workpiece which remains constant, regardless of the thickness of the workpiece. Also, the pivot point or end 30 of the jaw moves up or down by the hydraulic cylinders 28, 56 such that the angle of contact (the gripping angle) between the jaw and the workpiece remains the same regardless of the workpiece thickness.

Figure 14B:
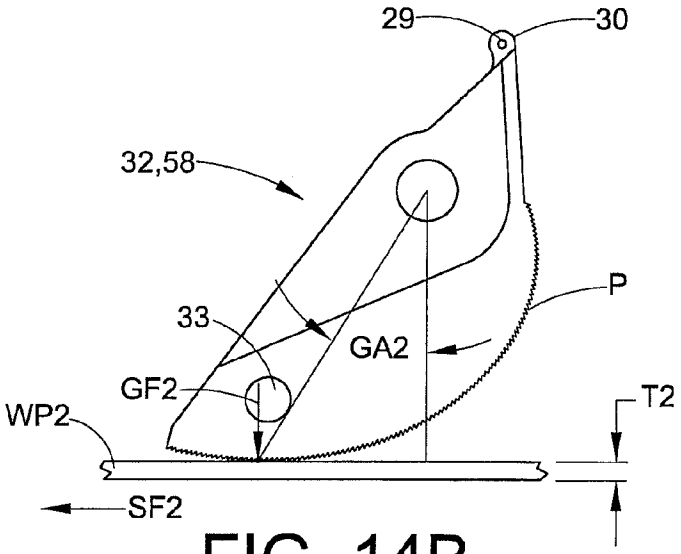
FIG. 14B is a side elevational view of a gripping angle of the cam-style jaw of the stretcher with a thin workpiece.
Figure 14A:
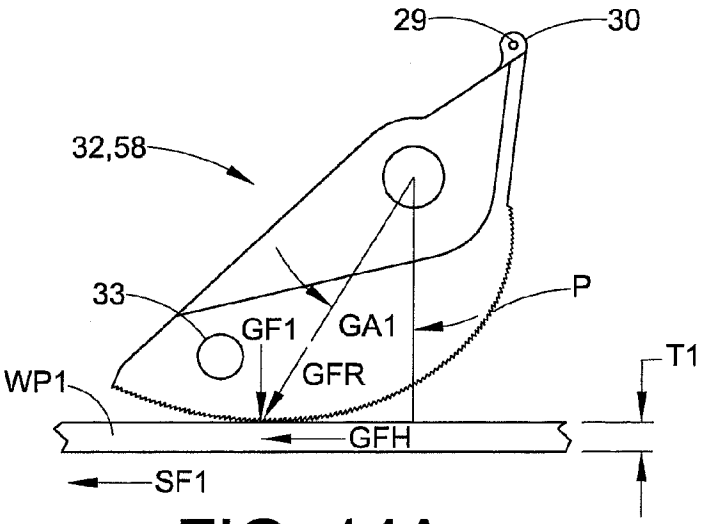
FIG. 14A is a side elevational view of a gripping angle of a cam-style jaw of the stretcher of the present disclosure.
Figure 14C:
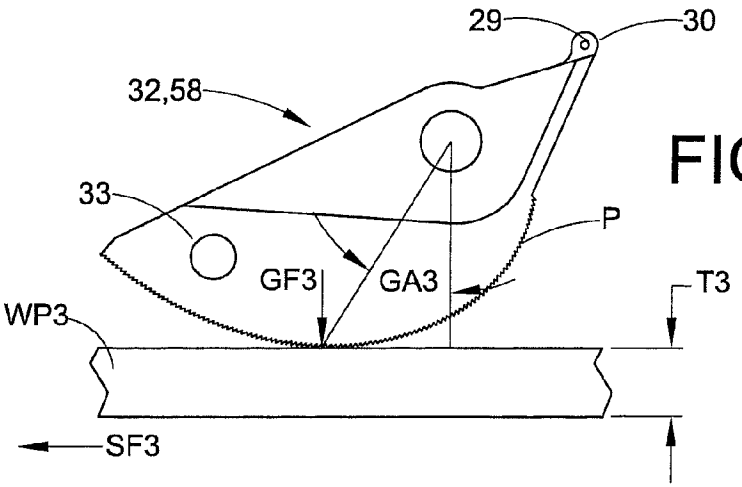
FIG. 14C is a side elevational view of a gripping angle of the cam-style jaw of the stretcher with a thick workpiece.

Specifically, the gripping angle (GA) of the eccentric cam-style jaw is shown in FIGS. 14A-14C. The gripping angle GA can range from about 15 degrees to about 45 degrees. The cam jaw has a geometrical eccentric cam profile P configured such that the gripping angle GA remains the same regardless of the thickness T of the extrusion or workpiece. The jaw pivots or rotates about hole 29 at end 30 when activated by cylinders 28, 56 and retains a constant gripping angle with the workpiece. This results in a gripping force which is proportional to the stretching force. Thus, the harder the stretcher pulls on the workpiece, the larger the gripping force on the workpiece. This eliminates virtually any slippage by the jaw.

Referring now to FIG. 14A, a jaw 32, 58 is shown in gripping contact with a workpiece WP1 having a thickness T1. The gripping angle or angle of contact (angle between a vertical line and the point of contact) is shown as GA1. The gripping force is GF1 and the stretching force is SF1. The stretching force SF1 can range from about 20 tons to about 15,000 tons. The gripping force GF1 can range from about 10 to 20 percent of the stretching force to two to three times the stretching force. The gripping force GF1 can be a vertical component of a resultant force GFR and GFH is a horizontal component of GFR such that $GFR=\sqrt{GF1^2+GFH^2}$. However, if the angle GA1 is zero, GF1 is equal to GFR.

Referring now to FIG. 14B, a thinner workpiece WP2 with a thickness T2 (less than T1) is shown. The jaw has to be rotated slightly upwardly at pivot end 30 by activating hydraulic cylinders 28, 56. The gripping angle or angle of contact is GA2, which is the same as GA1. The gripping force GF2 exerted on the workpiece is proportional to the stretching force SF2 exerted on the workpiece; that is, the ratio between GF1 and SF1 is the same as the ratio between GF2 and SF2.

Referring now to FIG. 14C, a thicker workpiece WP3 having a thickness T3 (more than T1) is shown. The gripping angle or angle of contact is GA3, which is the same as GA2 and GA1. The jaw has to be rotated downwardly at pivot point or end 30. The gripping force GF3 is exerted on the workpiece, as well as the stretching force SF3. Again, the ratio between the gripping force GF3 and SF3 is the same as between GF1 and SF1 and GF2 and SF2, so the gripping force remains proportional to the stretching force. The differing gripping angles GA1, GA2 and GA3 are all equal. The result is a gripping force GF which is always proportional to the stretching force SF. This results in a more reliable, uniform gripping force and reduces slippage.

In accordance with another aspect of the disclosure, an insert is provided which is mounted to the face of a stretcher or gripper jaw assembly to protect and prevent damage to a workpiece being stretched. More particularly, referring now to FIGS. 15-19, a stretcher assembly includes a moving head assembly 100 has protective inserts or pads 102,104 which are mounted to gripping faces 101, 103 of opposed upper and lower gripping jaw or stretcher assemblies 106,108 to protect sheet metal plate or strip 110 which is being fed through and gripped and stretched by the assembly. The protective inserts 102, 104 can also be used with the gripping jaw assembly shown in FIGS. 1-14 in much the same manner as discussed below.

A stretcher stretches the metal strip or plate to a stress level beyond the yield strength of the material. As the strip or plate yields, the shortest fibers are stretched farther in the "plastic" zone than the long fibers. In this manner, the fiber lengths are equalized and upon relaxation of the stretch, the strip or plate is flattened or leveled.

Depending on the strip thickness, width, and yield strength, a high amount of stretch tonnage is required to accomplish the goal. For example, a strip that is 0.5 inch thick×74 inches long×100,000 psi yield requires about 3,700,000 lbs. of pull force (i.e., about 1850 tons) to effectively stretch the strip.

To accomplish the desired stretching, the gripping or stretching system has to grip or "hang on" to the strip and not slip. Various gripping methods have been tried to minimize or reduce marking or deformations on the strip or plate. Gripping with mechanical jaws provides very high pull out retention but also can result in undesired deformed markings, indentations or imprints or scratches on the surfaces of the strip. To minimize the appearance of the marks or other deformations, the strip needs to be cut at these marks so that they don't appear elsewhere along the cut length of the sheet/plate.

Other gripping assemblies have attempted to use grip surfaces that do not leave a mark. These grip surfaces typically employ an elastomeric surface that is bonded to the sheet gripper. This process may be effective on dry strip but only has marginal or limited effectiveness on "oiled" or "wet" strip. The oily surfaces of the strip reduce the friction between the strip surfaces and the elastomer face. It is also not practical to clean the oil from the strip surface during each cycle since the strip would need to be oiled again after the stretch cycle is completed.

What is then needed is a grip surface insert that can process oiled as well as dry strip and does not form or leave a mark or deformation on the strip.

The resulting gripping system of FIGS. 15-19 processes all materials, including pickled and oiled, without causing objectionable or undesired marks on the surface of the processed material.

The gripping or stretching assembly includes machined wedges 107, 109, replaceable steel grippers 112, 114 that slide or mount on the wedges, and pads or inserts 102, 104 that are consumable or eventually removable and disposable that are retained against the gripping faces 101, 103 of the steel grippers. The inserts 102, 104 can be fabricated of chip board, cardboard, or any suitable consumable, durable or protective material. For example, the inserts 102, 104 can be made of any suitable material such as non-metallic (i.e., chipboard, cardboard) material or metallic material (such as steel or aluminum or soft metal).

Figure 15:
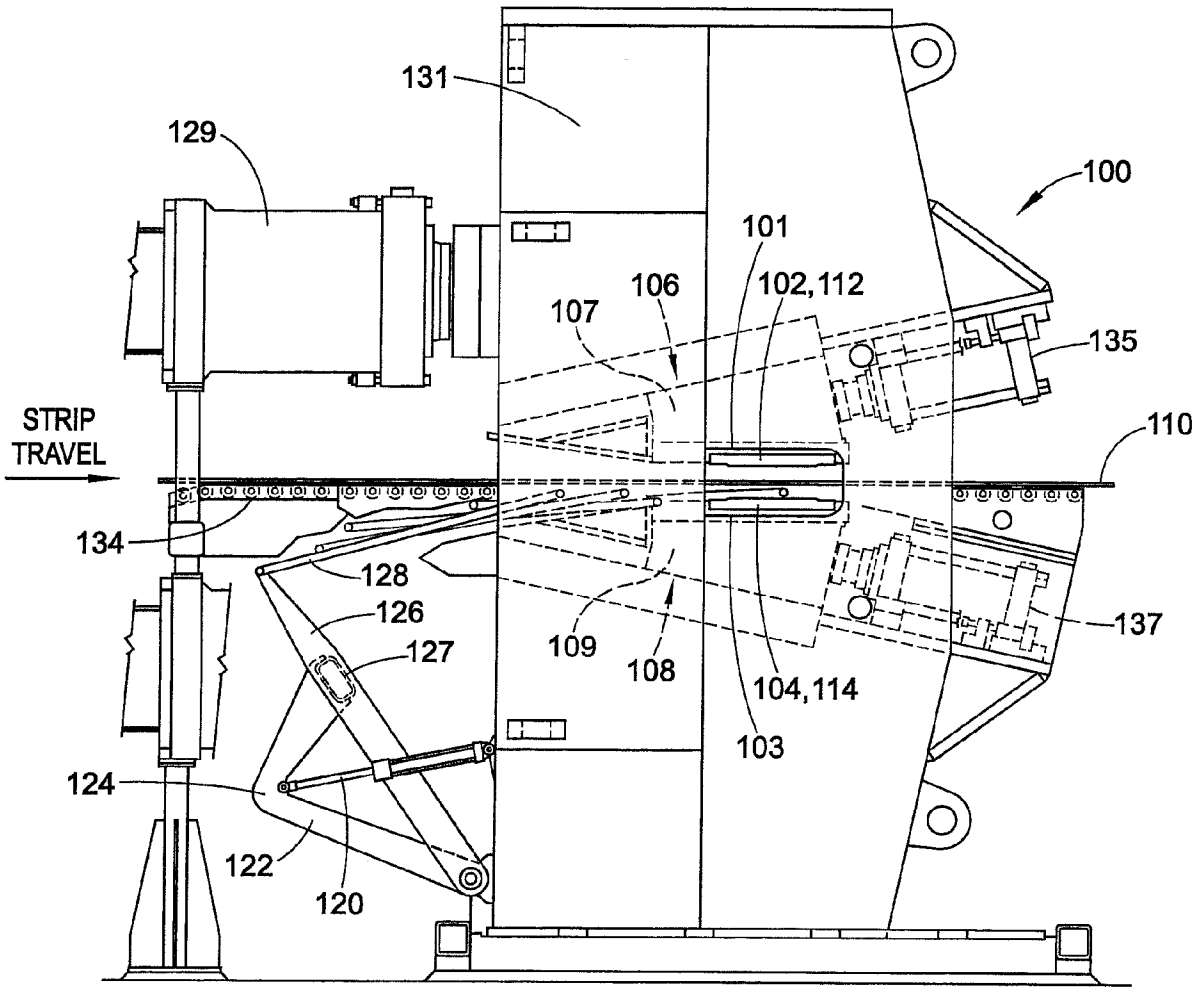
FIG. 15 is a side elevational view of a stretcher assembly with inserts mounted on the upper and lower grippers in accordance with another aspect of the disclosure.
Figure 16:
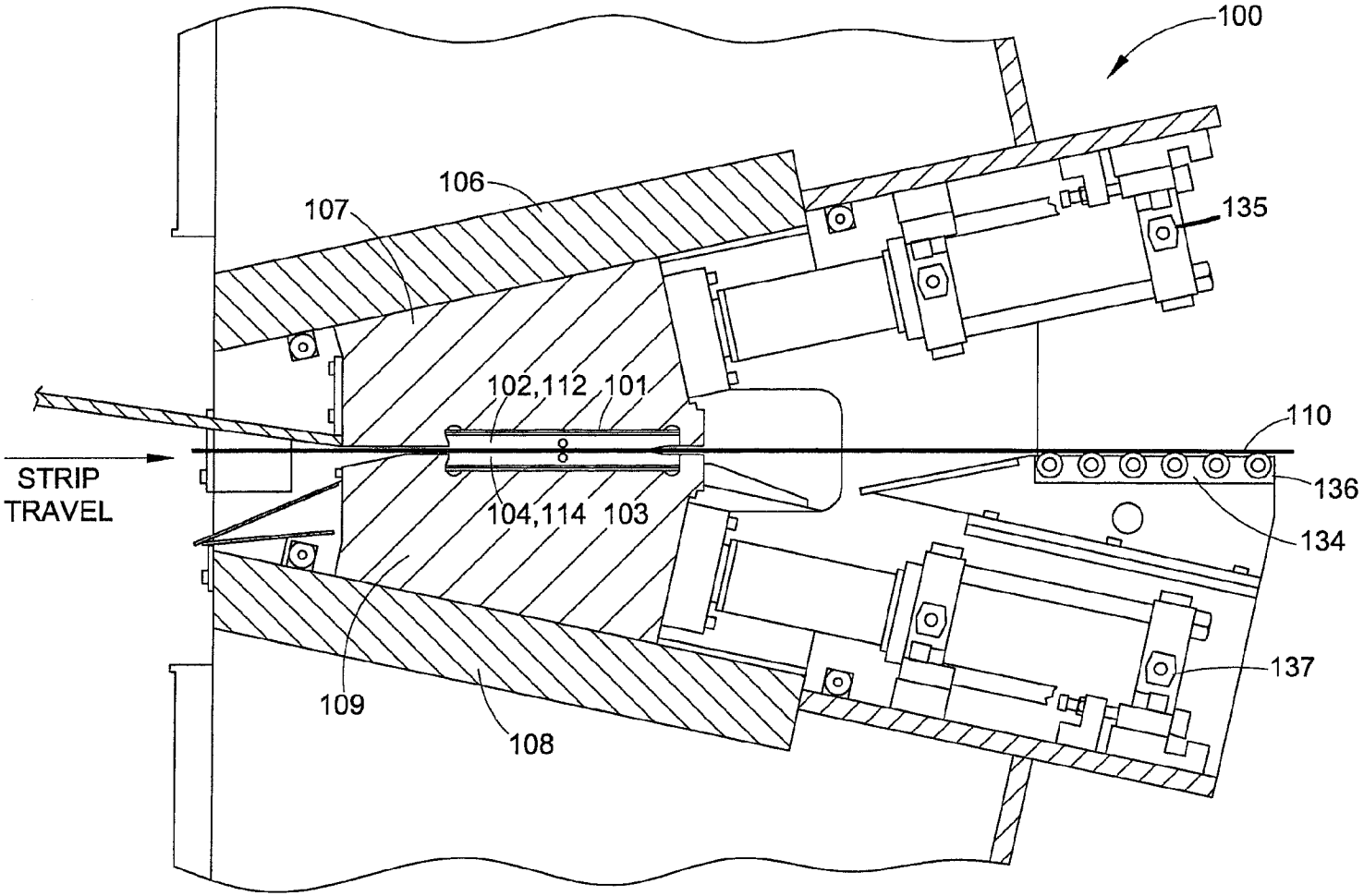
FIG. 16 is a side elevational view in cross section of the assembly with inserts mounted thereon of FIG.15.

Referring now to FIGS. 15 and 16, machined wedges 107, 109 are housed within a housing 131 are retained by mounting blocks 135, 137 and blocks 106, 108. A mounting block assembly 129 in turn is used to stabilize the stretching assembly 100. Wedge or gripping jaw 109 is pivotably connected to link 128 which in turn is connected to link arm 126 which in turn is mounted to angled arm 122 at part 127. A hydraulic cylinder or piston 120 is joined to arm 122 at pivot pin 124. As the hydraulic piston extends, the link 128 is pulled in a direction opposite to the strip travel and moves the lower gripping member 109 upward into contact with upper gripping member 107, thus causing contact and gripping of the workpiece 110, which is fed along conveyor line 134 along rollers 136. As the piston 120 retracts, the gripping members are moved out of contact with each other. Gripping faces 101, 103 are drawn toward each other resulting in gripping of the workpiece. Since the gripping surfaces 101, 103 are knurled or serrated, they can cause unsightly marks or deformations in the workpiece. Thus, there is a need for removable protective inserts to protect the surface of the workpiece.

Figure 17A:
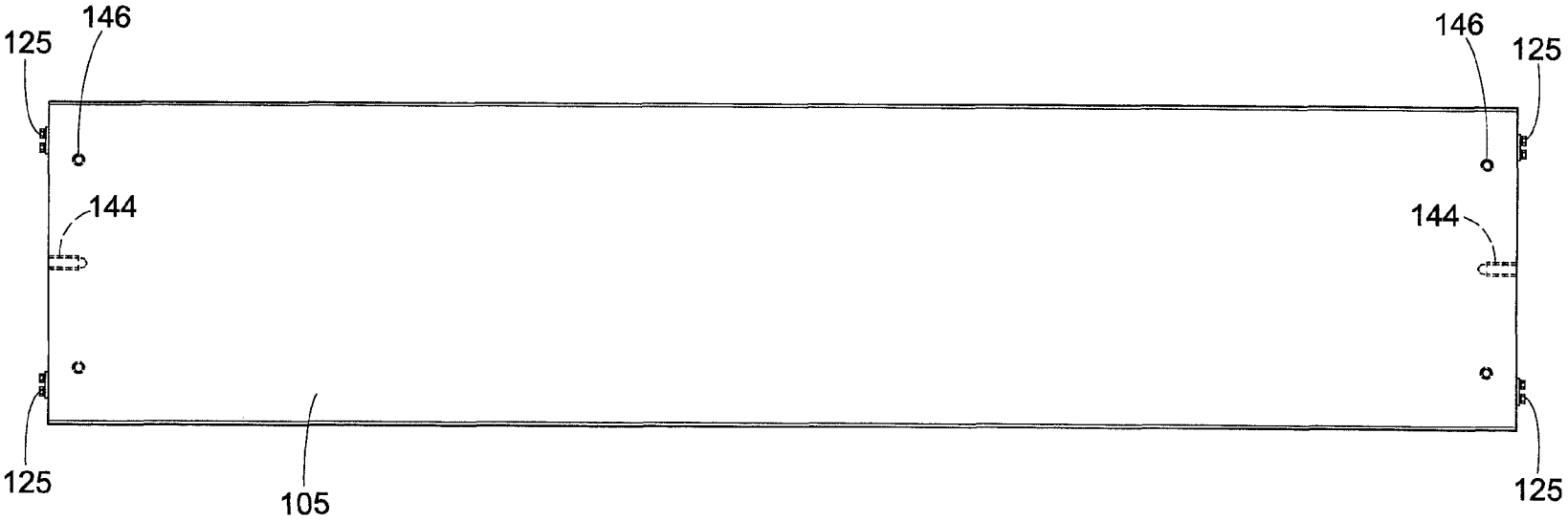
FIG. 17A is a top plan view of the insert of FIG. 15.
Figure 17B:
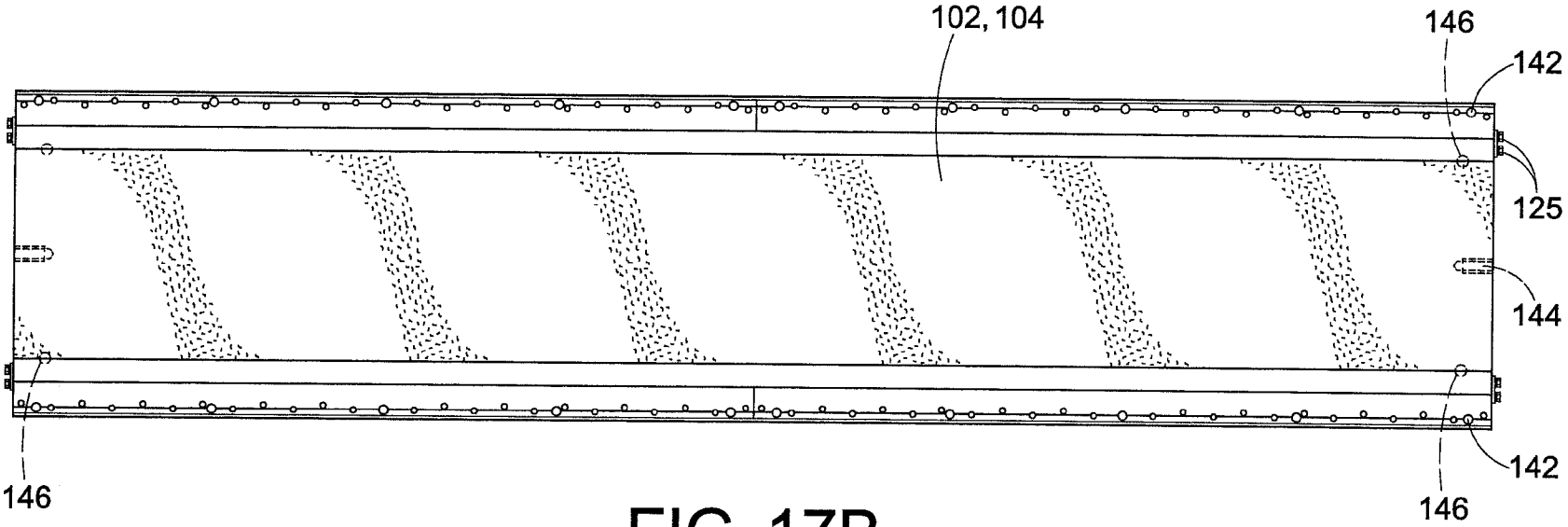
FIG. 17B is a bottom plan view of the insert of FIG. 15.
Figure 18:
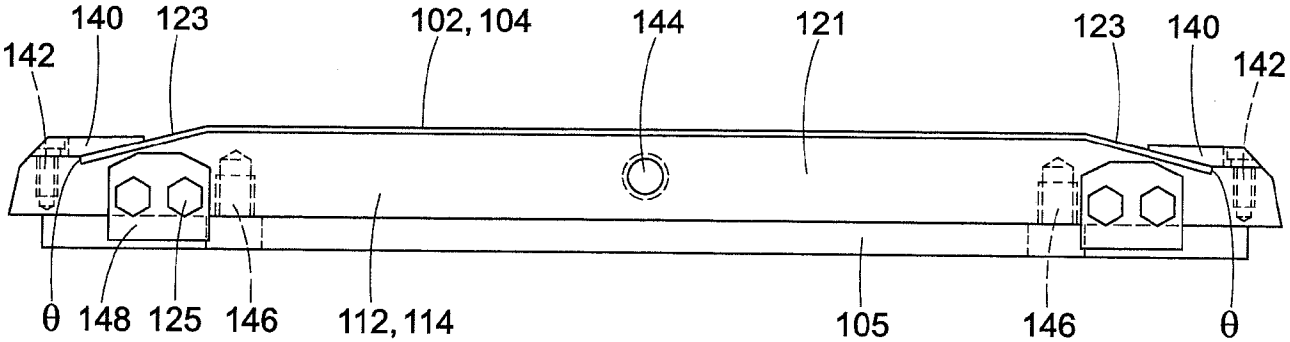
FIG. 18 is a side elevational view of the insert.

Referring particularly now to FIGS. 17A, 17B, and 18, the pads or inserts 102,104 are easily slid into two retention slots 123 formed in retention members 140 which in turn are secured by fasteners 142 to gripping assembly 112, 114. The slots 123 are formed or cut into the retention members 140 at angles θ, generally as shown, such as about 30 degrees or so. The slots themselves act as a means of retaining the consumable pads or inserts 102, 104. Other means for securing the pads on the assembly, such as fasteners, adhesives, etc., are also contemplated by the disclosure.

The consumable pads or inserts 102, 104 have a surface that has excellent friction characteristics against oiled strip. Upper member 105 of gripping assembly 112, 114 has holes 144 in side wall 121 used to insert and remove the gripping assembly into the stretcher onto wedges 107, 109. Holes 146 are used to lift the entire gripper assembly and can-receive fasteners therein. Side walls 121 are secured using retention plates 148 with fasteners 125.

Typically, the pads or inserts can process four coils of steel before the pads wear out and have to be replaced. Replacement is easily accomplished by sliding the worn pad out of the grooves or slots 123 and inserting a fresh or new pad. The inserts 102, 104 can be bent at outer ends to slide into slots 123.

Figure 19:
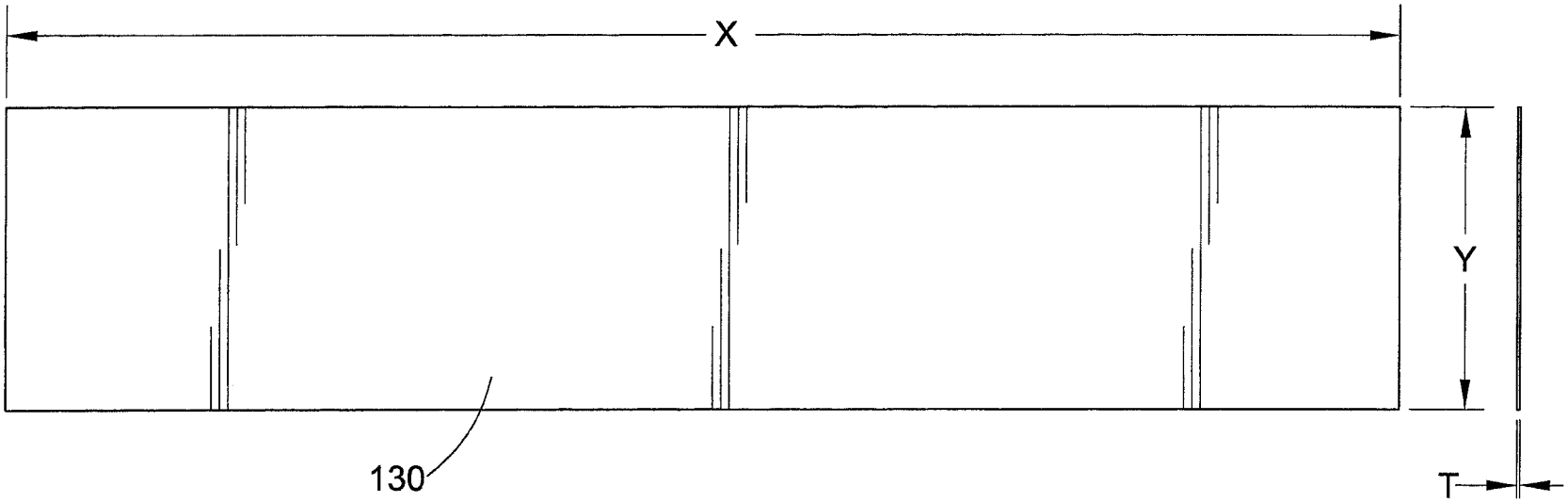
FIG. 19 is a top plan view of a chip board used as an insert.

Referring now to FIG. 19, one preferred type of consumable pad or insert is referred to as a chip board 130. Chip board is relatively inexpensive and readily available from multiple suppliers. Chip board has some compressibility that helps in compensating for various imperfections in the mechanical jaw assembly, thereby preventing excessively high loading in localized areas. In addition, the chip board has an effect similar to an ink blotter. This in effect absorbs some of the oil that is on the strip and helps account for the resultant high friction co-efficient.

Some examples of chip board 130 or inserts 102, 104 have thicknesses T from 0.030 inches up to 0.120 inches or more (preferably 0.080 inches) and lengths X from about 80 inches to about 100 inches or more. Width Y varies from 17 inches to 19¼ inches to 20¼ inches. Additionally, there are various densities of chip board. Density is measured in pounds per 1,000 sheets, for example, 2,600 pounds, 3,030 pounds or 3,600 pounds per 1,000 sheets. Different substrate surfaces on the metal gripper to determine the most effective solution hold the chip board in place without causing excessive wear to the back side of the chip board. Various surface treatments like tungsten carbide and different types of knurling can be used. A knurled surface is often used on the steel gripper plate.

Various types of hardboard of various thicknesses (i.e., fiberboard, Masonite, or pegboard) may also be used. Hardboard has good holding power and durability, but does not have good retention. To get the ends of the hardboard to attach to the steel gripper plate, the hardboard would have to be scored and the edges would have to be bent upwardly. However, during use, the hardboard would typically only last through a couple of stretches until it would break along the bent edge. If the hardboard is attached to the bottom gripper, it works effectively but is susceptible to being carried along with the strip as the strip pulled along and fed through the leveler.

Thus, an aspect of the disclosure is a consumable, inexpensive pad or insert (such as chip board) that grips oiled strip and does not leave a mark or deformation and results in a simple, easy, quick (installation occurs in under a minute) and efficient means of inserting and removing the consumable pad from the gripper by sliding the insert into retention slots in the gripping assembly which itself is removably mounted to wedges of the stretcher.

According to another aspect of the disclosure, there can be a first stretcher comprising a first housing 131 having a first clamping member 107 and a second clamping member 109 opposed to each other; and a second stretcher comprising a second housing 131 having a third clamping member 107 and a fourth clamping member 109 opposed to each other. A workpiece support member 134 is interposed between the first stretcher and the second stretcher; wherein the first and third clamping members 107 each has a movable pivot joint 124 such that an angle of contact of said first and third clamping members with a workpiece 110 to be gripped remains constant regardless of a thickness of the workpiece.

Each of the first, second, third, and fourth clamping members 107, 109 has an insert 102, 104 mounted thereon to protect the workpiece 110 to be gripped.

In accordance with another aspect of the disclosure, a method of stretching a workpiece 110 includes: providing a first stretcher assembly 100; providing a second stretcher assembly 100; providing a support member 134 extending between the first stretcher assembly and said second stretcher assembly; moving the first stretcher assembly into a desired location and securing the first stretcher assembly in the location; providing a pair of clamping members 107, 109 to each of said first and second stretcher assemblies; providing an insert 102, 104 releasably mounted to each of the clamping members 107, 109 to protect workpiece 134 to be stretched; feeding the workpiece 134 between the first and second stretcher assemblies 100; clamping the workpiece between the pair of clamping members 107, 109 by moving the clamping members 107, 109 until the clamping members exert a gripping force on the workpiece 130; wherein the clamping members 107, 109 are configured such that an angle of gripping contact between the clamping members and the workpiece remains constant regardless of the thickness of the workpiece; and moving the second stretcher away from the first stretcher to exert a stretching force on the workpiece.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A sheet metal stretching device comprising:

a housing;

a first clamping member attached to a first portion of said housing;

a second clamping member attached to a second portion of said housing;

a first gripping insert comprising chipboard releasably mounted to said first clamping member, wherein said first gripping insert has bent edges to slide into angled retention slots on said first clamping member; and a second gripping insert comprising chipboard releasably mounted to said second clamping member, wherein said second gripping insert has bent edges to slide into angled retention slots on said second clamping member, wherein said first insert and said second insert protect workpieces to be gripped and stretched therebetween.

2. The stretching device of claim 1, wherein first clamping member comprises a first wedge and second clamping member comprises a second wedge.

3. The stretching device of claim 2, wherein first clamping member comprises a first gripping member which is selectively mounted on said first wedge and said second clamping member comprises a second gripping member which is selectively mounted on said second wedge.

4. The stretching device of claim 3, wherein said first insert is releasably mounted on a gripping face of said first gripping member and said second insert is releasably mounted on a gripping face of said second gripping member.

5. The stretching device of claim 4, further comprising retention members secured to said first and second gripping members via fasteners.

6. The stretching device of claim 5, wherein said retention slots are formed at an angle on retention members.

7. The stretching device of claim 6, wherein said first and second inserts are releasably secured with said retention slots.

8. A sheet metal stretcher assembly comprising:

a first stretcher comprising a first housing having a first clamping member and a second clamping member opposed to each other; and a second stretcher comprising a second housing having a third clamping member and a fourth clamping member opposed to each other; a workpiece support member interposed between said first stretcher and said second stretcher; wherein said first and third clamping members each comprise a movable pivot joint such that an angle of contact of said first and third clamping members with a workpiece to be gripped remains constant regardless of a thickness of said workpiece; and each of said first, second, third, and fourth clamping members comprises an insert mounted thereon to protect said workpiece to be gripped;

wherein each of said inserts is bent and slid within angled retention slots formed in said first, second, third, and fourth clamping members.

9. The stretcher assembly of claim 8, wherein said first stretcher moves in relation to said second stretcher away from said second stretcher to stretch said workpiece.

10. The stretcher assembly of claim 9, wherein a gripping force of said first clamping member on said workpiece is proportional to a stretching force applied to said workpiece by said first and second clamping members.

11. The stretching assembly of claim 8, wherein said first clamping member is activated by a hydraulic cylinder attached to said housing.

12. The stretching assembly of claim 8, wherein said third clamping member is activated by a hydraulic cylinder attached to said housing.

13. The stretcher assembly of claim 8, wherein said first clamping member applies a gripping force to a workpiece proportional to a stretching force exerted of said workpiece by movement of said stretcher assembly along a longitudinal axis of said workpiece.

14. The stretching assembly of claim 8, wherein said inserts on each of said first, second, third, and fourth clamping members comprises chip board.

15. The stretching assembly of claim 8, wherein said inserts on each of said first, second, third, and fourth clamping members comprises cardboard.

16. The stretching assembly of claim 8, wherein said inserts are releasably mounted on gripping faces of said first, second, third, and fourth clamping members.

17. The stretching assembly of claim 16, further comprising retention members mounted to said clamping members wherein said inserts are mounted to said retention members.

18. The stretching assembly of claim 17, wherein said retention members are secured to said clamping members via fasteners.

19. The stretching assembly of claim 18, wherein said retention slots are formed at an angle on retention members.

20. The stretching assembly of claim 19, wherein said inserts are releasably secured with said retention slots.

21. The stretching assembly of claim 8, wherein said inserts on said each of said first, second, third, and fourth clamping members comprise metal.

22. A method of stretching sheet metal workpiece comprising: providing a first stretcher assembly; providing a second stretcher assembly; providing a support member extending between said first stretcher assembly and said second stretcher assembly; moving said first stretcher assembly into a desired location and securing said first stretcher assembly in said location; providing a pair of clamping members to each of said first and second stretcher assemblies; providing inserts releasably mounted to each of said clamping members by bending said inserts and inserting said inserts into angled retention slots formed in said clamping members to protect said workpiece to be stretched; feeding said workpiece between said first and second stretcher assemblies; clamping said workpiece between each pair of clamping members by moving said clamping members until said clamping members exert a gripping force on said workpiece; wherein said clamping members are configured such that an angle of gripping contact between said clamping members and said workpiece remains constant regardless of said thickness of said workpiece; and moving said second stretcher away from said first stretcher to exert a stretching force on said workpiece.

* * * * *